United States Patent [19]

Doguchi et al.

[11] 4,023,244

[45] May 17, 1977

[54] EMERGENCY OPENING SLIDER FOR SLIDE FASTENERS

[75] Inventors: Nobushige Doguchi, Toyama; Yoshinori Fujisaki, Kurobe, both of Japan

[73] Assignee: Yoshida Kogyo Kabushiki Kaisha, Japan

[22] Filed: Oct. 30, 1975

[21] Appl. No.: 627,075

[30] Foreign Application Priority Data

Nov. 9, 1974 Japan ..... 49-129346

[52] U.S. Cl. ..... 24/205.15 E; 24/205 R

[51] Int. Cl.[2] ..... A44B 19/26

[58] Field of Search .... 24/205.15 E, 205, 205.15 C

[56] References Cited

UNITED STATES PATENTS

| | | | |
|---|---|---|---|
| 2,237,935 | 4/1941 | Hossmann | 24/205.15 E |
| 2,398,947 | 4/1946 | Marinsky | 24/205 R |
| 2,621,387 | 12/1952 | Williams | 24/205.15 R |
| 2,764,794 | 10/1956 | Meech | 24/205.15 E |
| 2,946,109 | 7/1960 | Bashover | 24/205.15 E |
| 3,404,437 | 10/1968 | Plummer | 24/205.15 E |

FOREIGN PATENTS OR APPLICATIONS

| | | | |
|---|---|---|---|
| 312,621 | 5/1929 | United Kingdom | 24/205.15 E |
| 377,275 | 7/1932 | United Kingdom | 24/205.15 E |

*Primary Examiner*—Bernard A. Gelak
*Attorney, Agent, or Firm*—Bucknam and Archer

[57] ABSTRACT

An emergency opening slider to be mounted, in addition to the usual fastener slider, in any selected position on interlocked rows of fastener elements to permit the fastener to be forced open from the selected position in an emergency. The slider body has a guide channel therethrough which consists of contracted terminal portions at both ends and an expanded midportion, with the latter portion divided into a pair of branch channels where the rows of fastener elements are incapable of interlocking engagement. The slider body includes a portion or portions which, upon application of operating force as through a pull string connected thereto, are displaceable to permit disengagement of the fastener elements.

9 Claims, 9 Drawing Figures

EMERGENCY OPENING SLIDER FOR SLIDE FASTENERS

BACKGROUND OF THE INVENTION

This invention relates generally to slide fasteners, and in particular to the construction of a novel emergency opening slider which can be mounted in any selected position on interlocked rows of fastener elements or scoops and which, in the event of a fire or other emergencies, permits the fastener to be forced open from the selected position without resort to the use of the usual slider. The slide fastener of this character can be employed on entrances of camping tents and like articles to the best advantage.

There has been known a slide fastener with an emergency opening zone at its intermediate point where the rows of fastener elements are made incapable of interlocking engagement when the fastener is closed, in order that the fastener stringers may be manually spread apart from the zone in an emergency. The emergency opening zone is a predetermined zone where several fastener elements on each stringer tape are usually nonexistent. For the manufacture of the conventional slide fasteners with the emergency openable function, therefore, it it necessary to remove the several fastener elements from the completed stringers, or to form the stringers in which the unnecessary elements have not been attached to the tapes.

In either case the position of the emergency opening zone on the completed slide fasteners is not adjustable according to the specific applications or working conditions of the fasteners. For this reason the slide fastener manufacturers have heretofore been required to produce and keep in stock various types of fastener stringers having the emergency opening zones formed in different positions thereon. This practice necessitates high manufacturing and storage costs and renders the product management highly troublesome.

SUMMARY OF THE INVENTION

It is an object of this invention to provide an emergency opening slider of totally novel configuration which thoroughly overcomes the listed disadvantages of the prior art and which will virtually supersede the conventional slide fastener with the emergency opening zone.

Another object of the invention is to provide an emergency opening slider which can be installed in any desired position on the interlocking rows of fastener elements of a slide fastener to permit the same to be forced open from that position in an emergency.

A further object of the invention is to provide an emergency opening slider which can be employed on and in conjunction with slide fasteners of the usual construction, without the slightest modification of their existing parts.

With these and other objects in view this invention is directed, in brief, to the provision of an emergency opening slider having a body adapted to define therethrough a guide channel for interlocking rows of fastener elements. The guide channel includes contracted terminal portions at both ends and an expanded midportion so that the rows of elements emerge coupled together from either end of the body. Within the slider body there is mounted an island separator dividing the expanded midportion of the guide channel into a pair of branch channels where the rows of elements are incapable of interlocking engagement. The slider body includes a portion of portions which, upon application of operating force in an emergency, are displaceable relative to the rest of the body so as to permit separation of the fastener stringers.

Advantageously, the emergency opening slider according to the invention can be readily installed on usual slide fasteners, including those already in use on tents or other articles, without the slightest impairment of their closure strength. The emergency opening slider is movable to any desired position along the rows of fastener elements to suit the working conditions of the fastener, and in an emergency the slider itself serves to manifest the position from which the fastener can be forced open.

The features which are considered characteristic of this invention are set forth in particular in the appended claims. The invention itself, however, both as to its construction and manner of operation, together with the additional objects and advantates thereof, will become apparent from the following description of several typical embodiments, which is to be read in connection with the accompanying drawings in which like reference characters refer to like parts throughout.

DESCRIPTION OF THE PREFERRED EMBODIMENTS

Figure 1:
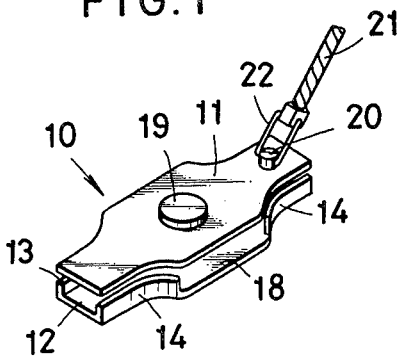
FIG. 1 is a perspective view of the emergency opening slider embodying this invention.
Figure 2:
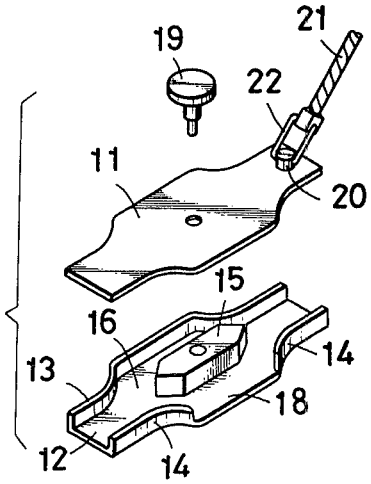
FIG. 2 is an exploded perspective view of the emergency opening slider of FIG. 1.

In FIGS. 1 to 5, inclusive, the emergency opening slider according to the invention is shown adapted for a slide fastener of the well known type. With particular reference to FIGS. 1 and 2 the illustrated emergency opening slider has a body 10 shaped just like a pair of conventional fastener sliders integrally combined with their flared ends opposed to each other.

The slider body 10 comprises top and bottom wings or plate members 11 and 12. The bottom wing 12 is formed to include a pair of guide flanges 13 and 14 along its marginal edges. Formed centrally on the interior face of the bottom wing 12 is an island separator 15 which can be in the form of a ship such as an elongated hexagon when seen in a plan view as in FIG. 3 and which is suitably elongated in the longitudinal direction of the slider body 10.

Figure 5:
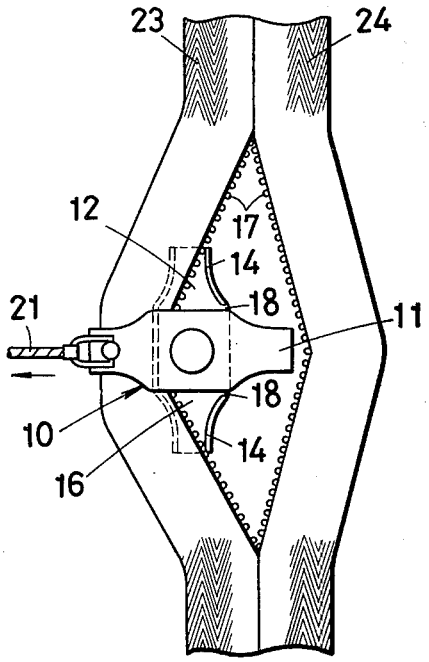
FIG. 5 is a view similar to FIG. 3 but showing the fastener partly opened by the emergency opening slider.
Figure 4:
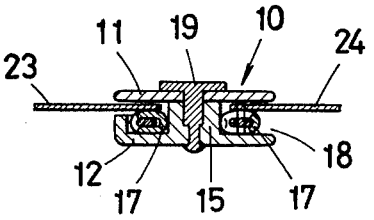
FIG. 4 is a sectional view taken along the plane of line IV—IV in FIG. 3.

It will now be clear that the slider body 10 with its top and bottom wings 11 and 12 is adapted to define therethrough a guide channel 16 for the interlockable rows of fastener elements 17, FIGS. 4 and 5, of the slide fastener. This guide channel consists of contrated terminal portions at both ends of the slider body and an expanded mid-portion therebetween, and the latter portion of the guide channel is further divided into a pair of parallel spaced branch channels by the island separator 15.

The marginal guide flange 14 on the bottom wing 12 has a recess 18 at the expanded mid-portion of the guide channel 16. The dimension of this recess 18 in the longitudinal direction of the slider body 10 is slightly in excess of the maximum width of the top wing 11. The top wing can be of planar configuration and is pivotally coupled to the island separator 15 on the bottom wing 12 as by a headed pin 19. A boss 20 is formed on the top wing 11 at one of its ends for connection of a pull string 21 via a connector ring 22.

Figure 3:
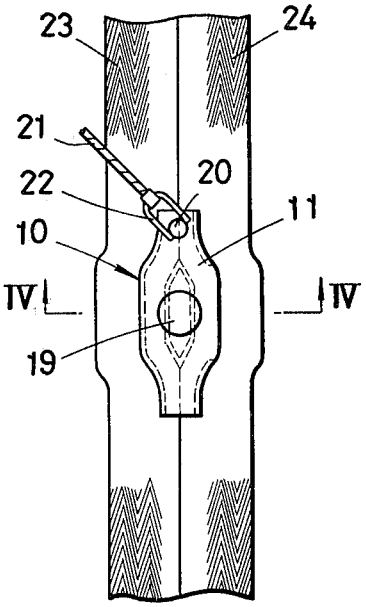
FIG. 3 is a fragmentary plan view of a slide fastener incorporating the emergency opening slider of FIGS. 1 and 2.

As will be seen from FIGS. 3 and 4, the emergency opening slider of the foregoing configuration can be mounted in any selected position on the rows of fastener elements 17 that are carried along the opposed longitudinal edges of stringer tapes 23 and 24 of the concealed slide fastener. The guide channel 16 of the emergency opening slider is such that the rows of fastener elements 17 emerge coupled together from either end of the slider body 10 as the slider is moved therealong. The fastener can therefore be held closed no matter where the emergency opening slider is installed on the rows of fastener elements. Within the slider body 10, however, the rows of fastener elements are partly unlocked by the island separator 15 intervening therebetween.

In the event of a fire or other emergency a manual pull may be exerted on the top wing 11 via the pull string 21 in the transverse direction of the fastener, as indicated by the arrow in FIG. 5. The top wing 11 will then pivot about the pin 19 into right-angular relationship to the bottom wing 12, and concurrently the complete emergency opening slider will move to the left, as viewed in FIG. 5, along with the stringer tape 23 that is engaged by the island separator 15.

Upon this lateral displacement of the emergency opening slider along with the stringer tape 23, the fastener elements 17 carried by the other stringer tape 24 will ride over the marginal guide flange 14 on the bottom wing 12 and finally escape through its recess 18. With the fastener stringers thus partly separated as shown in FIG. 5 a sustained pull may be exerted on the emergency opening slider via the pull string 21 or, alternatively, the partly open stringers may be directly forced apart from each other. The fastener is thus readily openable without resort to the use of the conventional slider, not shown, that is now assumed to be located on the closed position on the rows of fastener elements 17.

Figure 6:
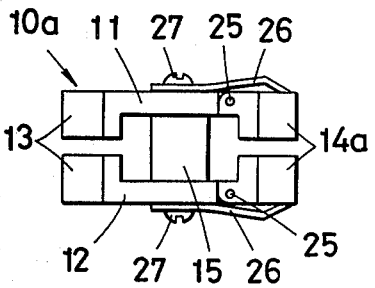
FIG. 6 is an end elevational view of another preferred embodiment of the invention.

FIG. 6 illustrates another preferred embodiment of the invention. As shown the emergency opening slider has a body **10*a* comprising the top and bottom wings 11 and 12 each including a pair of marginal guide flanges 13 and 14*a*. The top and bottom wings 11 and 12 can be integrally interconnected by the island separator 15**.

Characteristically, the two opposed guide flanges **14*a* of this emergency opening slider are pinned at 25 to the top and bottom wings 11 and 12, respectively, for pivotal movement away from each other. These pivotable guide flanges 14*a* are normally held in their illustrated positions as by leaf springs 26 which can be screwed or otherwise fastened at 27 to the respective wings. Other details of configuration are substantially as set forth above in conjunction with FIGS. 1 and 2** in particular.

It will be apparent that the emergency opening slider of FIG. 6 can also be mounted in any selected position on the interlocked rows of fastener elements of the slide fastener. In an emergency the slider may be pulled in the arrow-marked direction as through a pull string, not shown, connected to the slider body **10*a*. The guide flanges 14*a* will then pivot away from each other against the forces of the leaf springs 26 thereby releasing one of the fastener stringers. The fastener can be subsequently forced open completely in the manner previously explained with reference to FIG. 5**.

Figure 7:
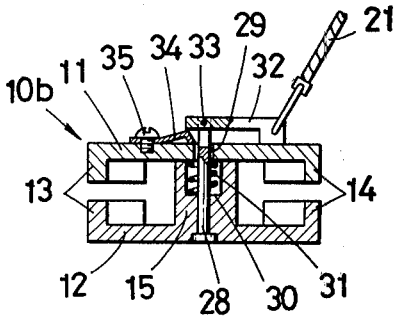
FIG. 7 is a cross sectional view of still another preferred embodiment of the invention.

According to still another preferred embodiment of the invention shown in FIG. 7, the emergency opening slider has a body **10*b* comprising the top and bottom wings 11 and 12 that are separable from each other. Each wing has the pair of marginal guide flanges 13 and 14, and the island separator 15 is formed integral with the bottom wing 12**.

A pin 28 planted centrally on the island separator 15 extends upwardly therefrom to pass with clearance through a bore 29 formed in the top wing 11. The island separator 15 is recessed at 30 to accommodate a helical compression spring 31 which is effective to urge the top wing 11 away from the bottom wing 12. The top end of the pin 28 projecting out of the bore 29 is bifurcated, and to this bifurcated end of the pin a lever 32 is pivotally coupled at 33 adjacent one of its ends.

A suitably crimped leaf spring 34 is affixed at 35 to the top wing 11 to engage the said one end of the lever 32 and hence to force the free end of this lever into abutting contact with the top wing. The leaf spring 34 thus coacts with the lever 32 to normally hold the top wing 11 in contact with the island separator 15 against the force of the compression spring 31. The pull string 21 is shown to be connected to the free end of the lever 32.

In the use of the emergency opening slider of FIG. 7 the pull string 21 may be pulled in a direction perpendicular to the top or bottom wing 11 or 12 in an emergency. The lever 32 will then pivot about the axis 33 against the force of the leaf spring 32, into alignment with the pin 28 planted on the island separator 15. As a consequence, the top wing 11 will move away from the bottom wing 12 under the influence of the compression spring 31 to release the fastener stringers from between the opposed guide flanges 13 and 14. The fastener can thus be forced open in an emergency as in the preceding embodiments of the invention.

Figure 8:
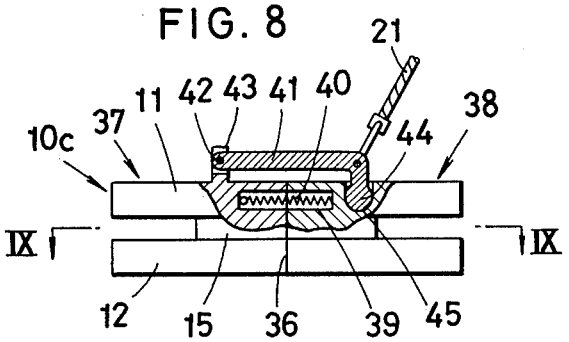
FIG. 8 is a side elevational view, partly broken away, of a further preferred embodiment of the invention.
Figure 9:
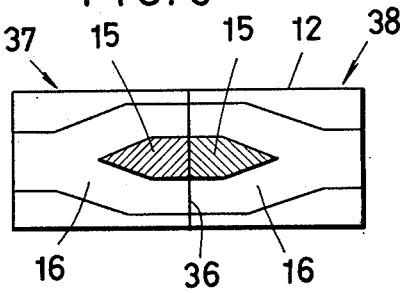
FIG. 9 is a sectional view taken along the plane of line IX—IX in FIG. 8.

FIGS. 8 and 9 illustrate a further preferred embodiment which differs from all the preceding embodiments in that its slider body **10*c* is transversely divided at 36 into separable halves 37 and 38. The top and bottom wings 11 and 12 of the slider body 10*c* are interconnected by the island separator 15**, which is also halved.

The top wing 11 has formed therein a chamber 39 that extends over both separable body halves 37 and 38. Accommodated in this chamber 39 is a helical compression spring 40 biasing the body halves 37 and 38 away from each other. Over the top wing 11 a lever 41 has one of its ends pivotally coupled at 42 to a mount 43 formed integral with the body half 37. The lever 41 has a head 44 at the other end which is bent right-angularly, and this lever head is normally snugly but releasably fitted in a depression 45 formed in the top wing 11 of the body half 38 to hold the body halves 37 and 38 in contact with each other against the bias of the compression spring 40. The pull string 21 can be connected to the headed end of the lever 41.

In an emergency a pull may be exerted on the lever 41 via the pull string 21 to cause withdrawal of its head 44 out of the depression 45. Thereupon the separable body halves 37 and 38 will move away from each other to an extent determined by the force of the compression spring 40, while unlocking the rows of fastener elements by their halved island separators 15. The fastener may then be manually forced open from its partial opening that has been formed by the separation of the body halves 37 and 38.

While the emergency opening slider according to this invention has been shown and described in various forms which it may assume in practice, it will be understood that these are merely for the purpose of illustration and explanation. A variety of additional forms may be devised within the scope of the invention as sought to be defined in the following claims.

What is claimed is:

1. In combination with a slide fastener which has a pair of stringers including interlockable rows of fastener elements, an emergency opening slider to be mounted in any selected position on said rows of fastener elements to permit the slide fastener to be forced open from the selected position into an emergency opening configuration, said emergency opening slider comprising a body adapted to define therethrough a guide channel for the rows of fastener elements, said guide channel including contracted terminal portions at both ends and an expanded mid-portion whereby the rows of fastener elements emerge coupled together from either end of said body, and an island separator within said body adapted to divide said expanded mid-portion of said guide channel into a pair of branch channels where the rows of fastener elements are incapable of interlocking engagement, said body including a portion which, upon application of operating force, is movable relative to the rest of said body to set the slider into said emergency opening configuration so as to permit separation of the stringers, said island separator and guide channel having cooperating configurations such that regardless of which direction the slider is moved along the rows of fastener elements, interlocked fastener elements entering the guide channel are decoupled as they pass along the island separator, and then recoupled into interlocking engagement before exiting the guide channel said body comprising a bottom wing having a pair of marginal guide flanges, one of said guide flanges having a recess at said expanded mid-portion, said bottom wing having said island separator fixedly mounted thereon, and a top wing pivotally coupled to said island separator on said bottom wing, said top wing having a maximum width less than the dimension of said recess in the longitudinal direction of said body.

2. The emergency opening slider as recited in claim 1, including a pull string connected to said top wing at one of its ends.

3. In combination with a slide fastener which has a pair of stringers including interlockable rows of fastener elements, an emergency opening slider to be mounted in any selected position on said rows of fastener elements to permit the slide fastener to be forced open from the selected position (in) into an emergency opening configuration, said emergency opening slider comprising a body adapted to define therethrough a guide channel for the rows of fastener elements, said guide channel including contracted terminal portions at both ends and an expanded mid-portion whereby the rows of fastener elements emerge coupled together from either end of said body, and an island separator within said body adapted to divide said expanded mid-portion of said guide channel into a pair of branch channels where the rows of fastener elements are incapable of interlocking engagement, said body including a portion which, upon application of operating force is movable relative to the rest of said body to set the slider into said emergency opening configuration so as to permit separation of the stringers, said island separator and guide channel having cooperation configurations such that regardless of which direction the slider is moved along the rows of fastener elements, interlocked fastener elements entering the guide channel are decoupled as they pass along the island separator, and then recoupled into interlocking engagement before exiting the guide channel, said body comprising top and bottom wings which are interconnected by said island separator, said top and bottom wings each having a pair of marginal guide flanges, the two opposed ones of said marginal guide flanges being pivotally coupled to the respective wings for movement away from each other, and wherein the slider further includes spring means normally holding said two opposed guide flanges in predetermined relative positions for defining said guide channel through said body.

4. In combination with a slide fastener which has a pair of stringers including interlockable rows of fastener elements, an emergency opening slider to be mounted in any selected position on said rows of fastener elements to permit the slide fastener to be forced open from the selected position into an emergency opening configuration, said emergency opening slider comprising a body adapted to define therethrough a guide channel for the rows of fastener elements, said guide channel including contracted terminal portions at both ends and an expanded mid-portion whereby the rows of fastener elements emerge coupled together from either end of said body, and an island separator within said body adpated to divide said expanded mid-portion of said guide channel into a pair of branch channels where the rows of fastener elements are incapable of interlocking engagement, said body including a portion which, upon application of operating force is movable relative to the rest of said body to set the slider into said emergency opening configuration so as to permit separation of the stringers, said island separator and guide channel having cooperating configurations such that regardless of which direction the slider is moved along the rows of fastener elements, interlocked fastener elements entering the guide channel are decoupled as they pass along the island separator, and then recoupled into interlocking engagement before exiting the guide channel, said body comprising top and bottom wings each having a pair or marginal guide flanges, said top wing having a bore formed centrally therethrough, said bottom wing having said island separator fixedly mounted thereon, and wherein the slider further comprises a pin extending upwardly from said island separator and passing through said bore in said top wing with clearance, first spring means urging said top wing away from said bottom wing, a lever pivotally coupled to the end of said pin projecting upwardly out of said bore in said top wing, and second spring means coacting with said lever to normally hold said top wing in contact with said island separator against the force of said first spring means, said lever being pivotable upon application of operating force against the force of said second spring means so as to permit said top wing to move out of contact with said island separator under the influence of said first spring means.

5. The emergency opening slider as recited in claim 4, wherein said lever is pivotally coupled to said pin adjacent one of its ends, and wherein said second spring means is a leaf spring normally engaging said one end of said lever to force the other end thereof into abutting contact with said top wing, said lever being pivoted into alignment with said pin upon application of operating force.

6. The emergency opening slider as recited in claim 5, including a pull string connected to said other end of said lever.

7. In combination with a slide fastener which has a pair of stringers including interlockable rows of fastener elements, an emergency opening slider to be mounted in any selected position on said rows of fastener elements to permit the slide fastener to be forced open from the selected position into an emergency opening configuration, said emergency opening slider comprising a body adapted to define therethrough a guide channel for the rows of fastener elements, said guide channel including contracted terminal portions at both ends and an expanded mid-portion whereby the rows of fastener elements emerge coupled together from either end of said body, and an island separator within said body adapted to divide said expanded mid-portion of said guide channel into a pair of branch channels where the rows of fastener elements are incapable of interlocking engagement, said body including a portion which, upon application of operating force, is movable relative to the rest of said body to set the slider into said emergency opening configuration so as to permit separation of the stringers, said island separator and guide channel having cooperating configurations such that regardless of which direction the slider is moved along the rows of fastener elements, interlocked fastener elements entering the guide channel are decoupled as they pass along the island separator, and then recoupled into interlocking engagement before exiting the guide channel, said body comprising top and bottom wings each having a pair of marginal guide flanges and interconnected by said island separator, said body being transversely divided into separable halves, and wherein the slider further comprises spring means urging said separable body halves away from each other, and a lever pivotally coupled to one of said body halves and normally releasably engaging the other body half to hold said body halves in contact with each other against the force of said spring means, said lever being pivotable upon application of operating force to release said other body half and hence to permit said body halves to move out of contact with each other under the influence of said spring means.

8. The emergency opening slider as recited in claim 7, wherein said lever is pivotally coupled at one end to the top wing of said one body half and has a head at another end, and wherein the top wing of said other body half has a depression adapted to snugly receive said head of said lever, said head of said lever being withdrawable from said depression upon application of operating force.

9. The emergency opening slider as recited in claim 8, including a pull string connected to said other end of said lever.

* * * * *